United States Patent [19]

Schumacher et al.

[11] 4,089,187

[45] May 16, 1978

[54] CONDENSER-AIR FLOW SYSTEM OF A HOUSEHOLD REFRIGERATOR

[75] Inventors: Frank A. Schumacher; Earl H. Magester, both of Louisville, Ky.

[73] Assignee: General Electric Company, Louisville, Ky.

[21] Appl. No.: 778,630

[22] Filed: Mar. 17, 1977

Related U.S. Application Data

[63] Continuation-in-part of Ser. No. 589,409, Jun. 23, 1975, abandoned.

[51] Int. Cl.[2] ..... F25B 39/04

[52] U.S. Cl. ..... 62/289; 55/319; 62/507

[58] Field of Search ..... 62/428, 507, 289; 55/319; 165/171

[56] References Cited

U.S. PATENT DOCUMENTS

| | | | |
|---|---|---|---|
| 1,590,218 | 6/1926 | Williams | 62/507 X |
| 2,017,201 | 10/1935 | Bossart et al. | 165/171 X |
| 2,304,411 | 12/1942 | Keighley | 62/428 X |
| 2,793,711 | 5/1957 | King et al. | 55/319 |
| 2,865,181 | 12/1958 | Anderson et al. | 62/428 X |
| 3,330,131 | 7/1967 | Papst | 62/507 X |
| 3,677,029 | 7/1972 | Schaeffer et al. | 62/428 X |

FOREIGN PATENT DOCUMENTS

| | | | |
|---|---|---|---|
| 40,843 | 1/1937 | Netherlands | 62/507 |

*Primary Examiner*—William E. Wayner
*Assistant Examiner*—William E. Tapolcai, Jr.
*Attorney, Agent, or Firm*—Steven C. Schnedler; Francis H. Boos

[57] ABSTRACT

A household refrigerator having a condenser and a fan for passing air over the condenser. The fan is positioned in a fan orifice of an air channel which is of a construction to reduce the foreign substance in the air-stream and thereby reduce the labor of cleaning the condenser and maintain the efficiency of the condenser at a high value.

13 Claims, 4 Drawing Figures

CONDENSER-AIR FLOW SYSTEM OF A HOUSEHOLD REFRIGERATOR

CROSS REFERENCE TO RELATED APPLICATION

This is a continuation-in-part of Application Ser. No. 589,409, filed June 23, 1975, now abandoned.

BACKGROUND OF THE INVENTION

Household refrigerators include a condensing component of the refrigeration system which has a compressor and a condenser and a fan for the forced circulation of ambient or indoor air over the condensing unit for cooling purposes. The condenser usually comprises a serpentine refrigerant tubing provided with a plurality of closely spared wire or plate-type fins mounted on or bonded to a sheet of metal. It is well known that during operation of a forced air cooled condenser of this type, foreign substances present in the stream of household air circulated over the condenser collect on the surfaces and eventually build up to an insulating layer which materially decreases the condensing capacity of the condenser.

The collection of such foreign substances on the condenser surfaces and the eventual clogging of the air passages therein constitutes a particular problem in the household refrigerator art. The foreign substances carried by or comingled with the household airstream passing over a household refrigerator condenser include not only particulate matter such as lint and dust but also a fluid component, usually an oil or grease, which not only accelerates the collection of the particulate component on the condenser surface but also prevents the circulating airstream from dislodging the lint and dust-like particles from the condenser surface once they have come in contact therewith. Because of this heterogenous composition of the foreign substances present in the household airstream, household refrigerator condensers require periodic cleaning much more frequently than condensers operating, for example, in outdoor ambients. In fact, many complaints of loss of cooling capacity are in fact due only to clogged or coated condensers. Therefore, various means have been used or proposed for preventing the loss of condenser efficiency resulting in these complaints. However, none of the means heretofore used or proposed have been completely satisfactory either from an operational or cost standpoint.

An obvious solution to the problem is the provision of an air filter ahead of the condenser. However, because of the limited space available in a household refrigerator cabinet and particularly because the average user forgets that this filter must periodically be changed or cleaned, the provision of a filtering means has usually been found to result in an actual increase, rather than a decrease, in such service calls. It has also been proposed to provide a reversible fan means on the theory that foreign substances "filtered" from the circulating airstream as the air flows in one direction will be removed from the condenser by the reversed flow of air. However, because the liquid or greasy particles in household air tend to bond the dust and lint particles to the condenser surfaces and to one another, the mere reversal of the airstream does not serve to dislodge any substantial portion thereof. Another proposed solution to this problem has been the provision of electrically operated heating means or, in order words, a "lint burner" ahead of or in contact with the condenser. However, the addition of such means materially increases the cost of the refrigerator.

The problem of maintaining the efficiency of the condenser at a high value while materially reducing the labor of repeatedly cleaning the condenser is solved by this invention.

SUMMARY OF THE INVENTION

In accordance with this invention, a household refrigerator has a condenser and a fan for passing air over the condenser. An air channel directs the air from adjacent the refrigerator, through the fan and over the condenser. The air channel has an inlet orifice, an outlet orifice, a fan orifice positioned between said inlet and outlet orifices, and a chamber between said inlet orifice and said fan orifice. The fan orifice has the fan positioned therein for moving the air through the air channel. The outlet orifice is directed upwardly and toward the condenser. The chamber is of a size sufficient for reducing the velocity of air flow therethrough to a value sufficiently low for causing a substantial volume of foreign substances entering the chamber to be maintained in said chamber.

DESCRIPTION OF THE PREFERRED EMBODIMENTS

Figure 1:
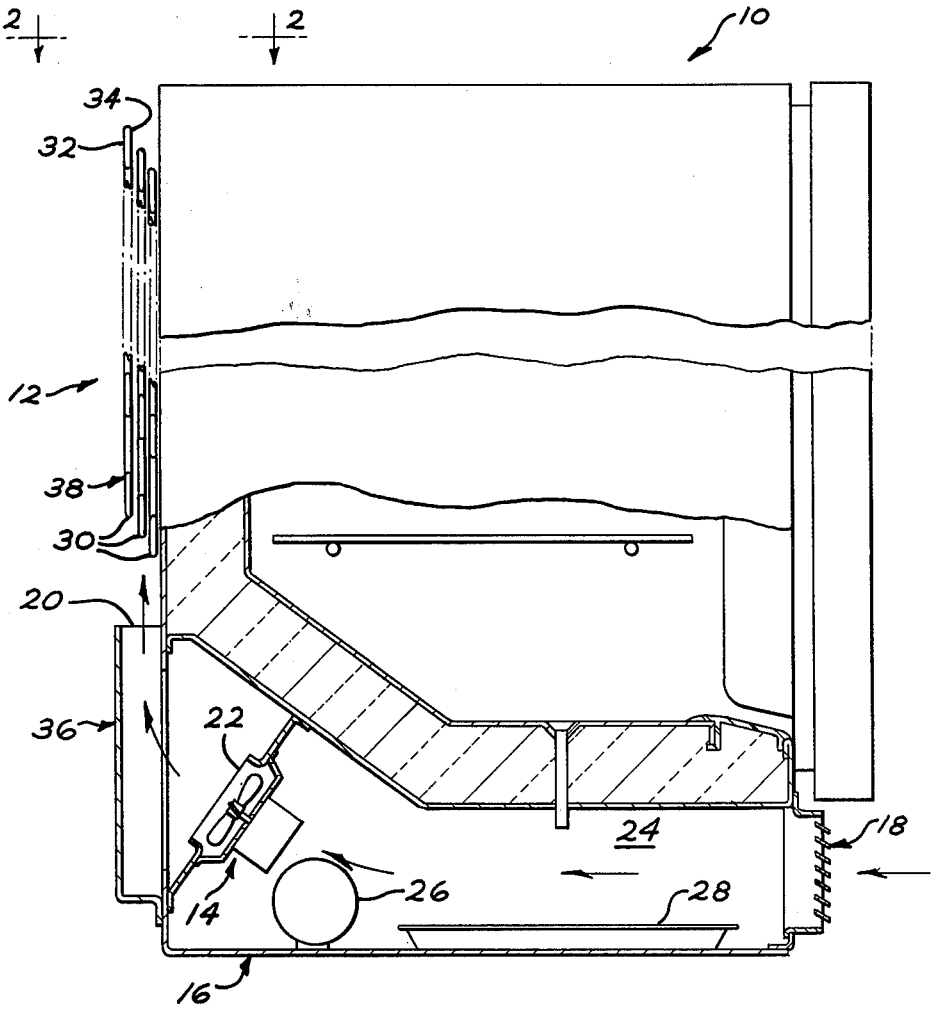
FIG. 1 is a diagrammatic side view in partial section of a household refrigerator having the improved condenser-air flow system of this invention.

In the embodiment of FIG. 1, a household refrigerator 10 has a condenser 12 mounted on a back of the refrigerator cabinet and a condenser fan 14 for passing an airstream over the condenser 12. An air channel 16 extends beneath the refrigerator 10 for passing an airstream from adjacent the refrigerator, through the air channel 16 and onto the condenser 12.

The air channel 16 has an inlet orifice 18, an outlet orifice 20, a fan orifice 22, and a chamber 24. The fan orifice 22 is positioned between the inlet and outlet orifices 18, 20 and the chamber 24 is between the inlet and fan orifices 18, 22.

The condenser fan 14 is positioned in the fan orifice 22. The fan orifice is substantially the same diameter as the fan blades to assure that substantially all of the airstream passes through the fan blades in order to assure control over the flow rate of the airstream through the air channel 16.

The chamber 24 is of a size sufficient for reducing the velocity of air flow therethrough to a value sufficiently low for causing a substantial volume of airborne foreign substances entering the chamber 24 to be maintained in said chamber. The chamber size is therefore dependent upon the sizes of the fan 14 and the inlet orifice 18. Once the fan has been sized for sufficiently cooling the condenser 12, one skilled in the art can easily determine the sizes of the inlet orifices 18 and chamber 24 which will cause the foreign substances to be maintained in the chamber 24 during the operation of the refrigerating system. The following table shows sizes of one embodiment of the invention.

TABLE

| | Area | Avg. Velocity |
|---|---|---|
| Inlet orifice (18) | 322.6 $Cm^2$ | 105 m/min. |
| Chamber (24) | 1455 $Cm^2$ | 23.4 m/min. |
| Fan orifice (22) | 198.1 $Cm^2$ | 171.6 m/min. |
| Outlet orifice (20) | 206.5 $Cm^2$ | 164.3 m/min. |
| Fan delivery rate | 3.398 $m^3$/min. | |

It has also been determined that if the flow rate of the airstream through the chamber 24 is maintained at a velocity less than about 35 m/min., a substantial portion of the airborne foreign substances, as set forth above, will be maintained in the chamber 24 and not be carried by the airstream and deposited on the condenser 12. At velocities greater than about 50 m/min., there will generally be a sufficient volume of foreign material deposited on the condenser 12 to seriously reduce the efficiency of the condenser 12 during the operational life of the refrigerator 10.

A water evaporating pan 28 is positioned in the chamber 24 at a location upstream of the compressor 26. Resultant water from defrosting the refrigerator 10 is contained in the water pan 28, evaporatores, and passes into the airstream of the air channel 16.

In order to further assure maintaining the efficiency of the condenser 12 at a high value, it is preferred that the condenser 12 have a plurality of generally horizontally extending tubes 30 with said tubes 30 being free of heat exchange protuberances, such as plate or fin-type heat exchange elements. To reduce impedance to airflow, these condenser tubes substantially all have flattened opposed side portions 32, 34 aligned substantially parallel with the direction of air flow discharging from the outlet orifice 20 of the air channel 16. Further, it is preferred that each of the smooth-surfaced condenser tubes 30 is generally vertically and horizontally spaced from an adjacent tube. By providing condenser tubes 30 of flattened configuration and orienting them relative to the direction of air flow, the efficiency of the bare tubes is markedly improved.

The tubes 30 of this invention are preferably about ¼ inch or 6.35 mm. OD but are flattened to a thickness of less than about 3/16 inch or about 5 mm. The tubes 30 are staggered horizontally about ⅜ inch or about 0.375 mm. on center, having three rows, and with about a ⅞ inch or about 0.875 mm. vertical stagger between centers, as shown in the drawings.

Figure 2:
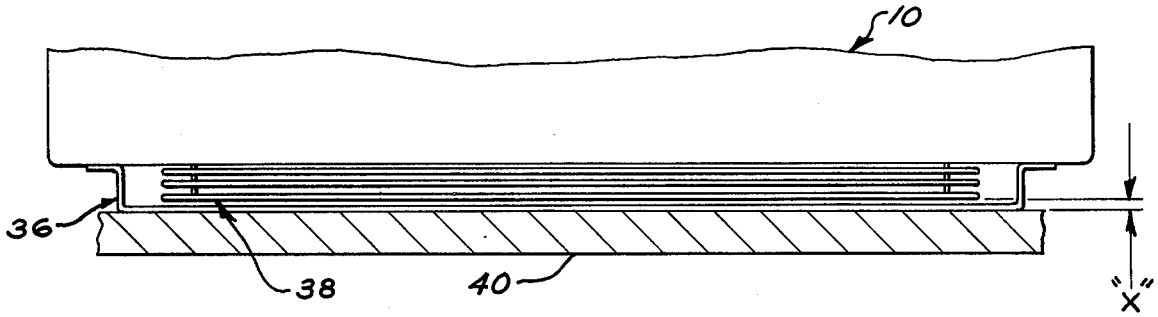
FIG. 2 is a diagrammatic partial top view taken along line 2—2 of FIG. 1 showing the discharge orifice of the air channel.

Referring to FIG. 2, the outer surface 36 of the outlet orifice 20 is laterally spaced from the outer surfaces 38 of the condenser 12 a distance sufficient to space the condenser outer surfaces 38 a preselected distance "X" from a generally vertical wall 40 when said outlet orifice outer surface 36 is contacting said wall 40. This preselected distance "X" is at least about 19 mm. and preferably in the range of about 19 mm. to about 32 mm.

By so constructing the outlet orifice 20 relative to the condenser 12, the outlet orifice 20 assures a proper clearance of the condenser 12 from the wall 40 when the refrigerator 10 is positioned against the wall. However, since the outlet orifice 20 directs the airstream upwardly onto the condenser tubes 30, the condenser is sufficiently cooled in the absence of a wall 40.

Figure 3:
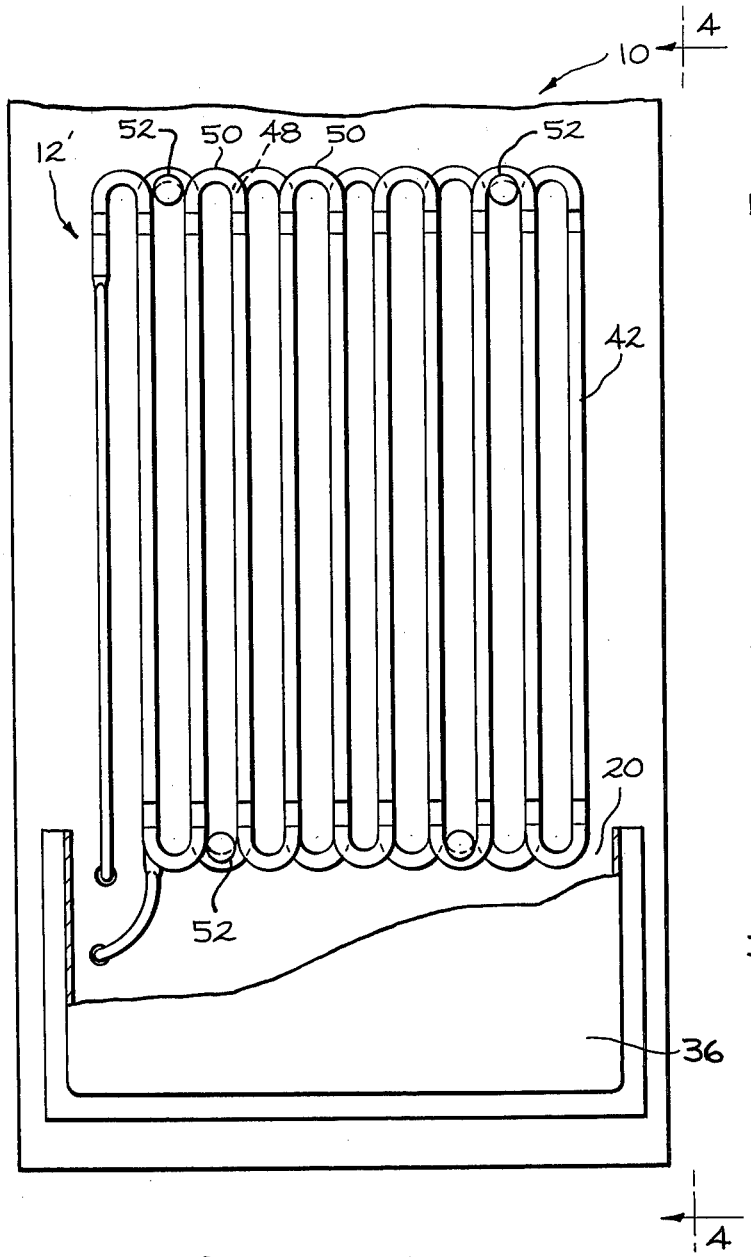
FIG. 3 is a diagrammatic rear view of a household refrigerator having an alternative embodiment of the condenser.
Figure 4:
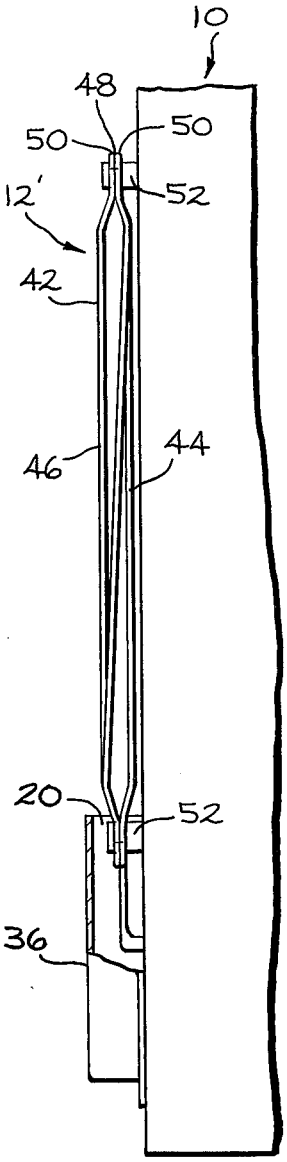
FIG. 4 is a side view taken along line 4—4 of FIG. 3.

Referring now to FIGS. 3 and 4, a presently preferred embodiment of the invention is characterized by an alternative condenser embodiment 12' having generally vertically extending tube sections 42. The air flow direction is along the lengths of the tube sections 42. As in the previously described embodiment, the tube sections 42 are generally free of heat exchange protuberances. Experiments have shown that the vertically extending tube sections 42 with air flow as described tend to accumulate less dust in a given period of time compared to a condenser having horizontally extending tubes.

The specific vertical tube condenser 12' illustrated comprises inner and outer serpentine layers 44, 46. To form a strong, rigid structure, the layers 44, 46 are joined by welding or brazing in the vicinity of each of the transitions 48 between the vertical tube sections 42 and the return bends 50. This construction avoids the need for horizontal structural members which would tend to collect dust. The tube sections 42 are thus arranged in joined pairs, one member of each pair being from the inner serpentine layer 44 and the other member being from the outer serpentine layer 46. To permit air to flow between the tube sections of each pair, the tube sections 42 each bend slightly away from the junctions at 48 so as to be in parallel spaced relationship along the substantial portions of their vertical extents.

In order to conserve space, the tube sections 42 of the condenser 12' are also flattened, with the flat sides facing the front and the rear. To complete the assembly, the condenser 12' mounted to the rear of the refrigerator 12 and slightly spaced therefrom by any suitable means such as the illustrated brackets 52, which are curved to avoid collecting dust.

Other modifications and alterations of this invention will become apparent to those skilled in the art from the foregoing discussion and it should be understood that this invention is not to be unduly limited thereto.

What is claimed is:

1. In a household refrigerator having a condenser mounted on the back of the refrigerator cabinet and a fan for passing air over the condenser, the improvement comprising:

an air channel adjacent the underside of the refrigerator having an inlet orifice, an outlet orifice, a fan orifice positioned between said inlet and outlet orifices, and a chamber between said inlet and fan orifices, said fan orifice having the fan positioned therein, said outlet orifice being directed toward the condenser, and said chamber being of a sufficient size between the inlet orifice and the fan orifice for maintaining the rate of air flow therethrough at a velocity sufficiently low for causing a substantial volume of foreign substances entering the chamber to settle out of the air flow and be maintained in said chamber so as not to clog up the condenser.

2. A household refrigerator, as set forth in claim 1, wherein an outer surface of the outlet orifice of the air channel is laterally spaced from the outer surfaces of the condenser a distance sufficient to space the condenser outer surfaces a preselected distance from a generally vertical wall when said outlet orifice outer surface is contacting said wall.

3. A household refrigerator, as set forth in claim 2, wherein said distance is at least 19 mm.

4. A household refrigerator, as set forth in claim 1, including a water evaporating pan positioned in said first chamber.

5. A household refrigerator, as set forth in claim 4, wherein a compressor of the refrigerator is positioned in the air channel at a location downstream of the water evaporating pan.

6. A household refrigerator, as set forth in claim 1, wherein the condenser has a plurality of tubes with said tubes being free of protuberances.

7. A household refrigerator, as set forth in claim 6, wherein substantially all of the condenser tubes have flattened opposed side portions and the tubes are oriented with the flattened portions substantially parallel to the direction of air flow from the air channel.

8. A household refrigerator as set forth in claim 1, wherein the condenser has generally vertically extending tube sections.

9. A household refrigerator as set forth in claim 8, wherein the condenser comprises inner and outer serpentine layers joined in the vicinity of the transitors between the vertical tube sections and the return bends and arranged in spaced pairs.

10. A household refrigerator as set forth in claim 8, wherein the tube sections are flattened, with the flat sides facing the front and rear of the refrigerator.

11. A household refrigerator as set forth in claim 8, wherein the condenser tube sections are free of protuberances.

12. A household refrigerator as set forth in claim 8, which is substantially free of horizontal structural members.

13. In a household refrigerator having a condenser with a plurality of tubes and a fan for passing air over the condenser, the improvement comprising:

an air channel having an inlet orifice, an outlet orifice, a fan orifice positioned between said inlet and outlet orifices, and a chamber between said inlet and fan orifices, said fan orifice having the fan positioned therein, said outlet orifice being directed toward the condenser, and said chamber being of a size sufficient for maintaining the rate of air flow therethrough at a velocity sufficiently low for causing a substantial volume of foreign substances entering the chamber to be maintained in said chamber;

the condenser tubes being free of protuberances; and each of the condenser tubes being generally vertically and horizontally spaced from an adjacent tube.

* * * * *

UNITED STATES PATENT AND TRADEMARK OFFICE

CERTIFICATE OF CORRECTION

PATENT NO. : 4,089,187

DATED : May 16, 1978

INVENTOR(S) : Schumacher et al

It is certified that error appears in the above-identified patent and that said Letters Patent are hereby corrected as shown below:

Column 5, Line 18, Claim 9, the word "transitors" should be "transitions"

Signed and Sealed this

*Third* Day of *October 1978*

[SEAL]

*Attest:*

RUTH C. MASON
*Attesting Officer*

DONALD W. BANNER
*Commissioner of Patents and Trademarks*